United States Patent [19]

Kornaker

[11] Patent Number: 4,495,438

[45] Date of Patent: Jan. 22, 1985

[54] DEVICE FOR ADJUSTING ELECTRON BEAMS IN A CATHODE-RAY TUBE

[75] Inventor: Walter Kornaker, Berkheim, Fed. Rep. of Germany

[73] Assignee: ITT Industries, Inc., New York, N.Y.

[21] Appl. No.: 380,793

[22] Filed: May 21, 1982

[30] Foreign Application Priority Data

Jun. 12, 1981 [DE] Fed. Rep. of Germany ..... 3123301

[51] Int. Cl.[3] ..... H01J 29/51

[52] U.S. Cl. ..... 313/412

[58] Field of Search ..... 313/409, 412

[56] References Cited

U.S. PATENT DOCUMENTS 3,614,502 10/1971 Doggett et al. ..... 313/412

4,377,767 3/1983 Kornaker ..... 313/412

*Primary Examiner*—Palmer Demeo

*Assistant Examiner*—Sandra L. O'Shea

*Attorney, Agent, or Firm*—Donald J. Lenkszus

[57] ABSTRACT

A magnetic ring for adjusting color purity and convergence is secured to the electron gun of a color-picture tube. It encloses an oblong area which is perpendicular to the plane defined by the three electron beams produced by the electron gun. The shape of the magnetic ring is chosen so that the y-distance of the ring from the central axis of the central electron beam is greater than the distance of the ring from the respective central axis of an outer electron beam. This selection of distances influences the focus of the beams.

36 Claims, 10 Drawing Figures

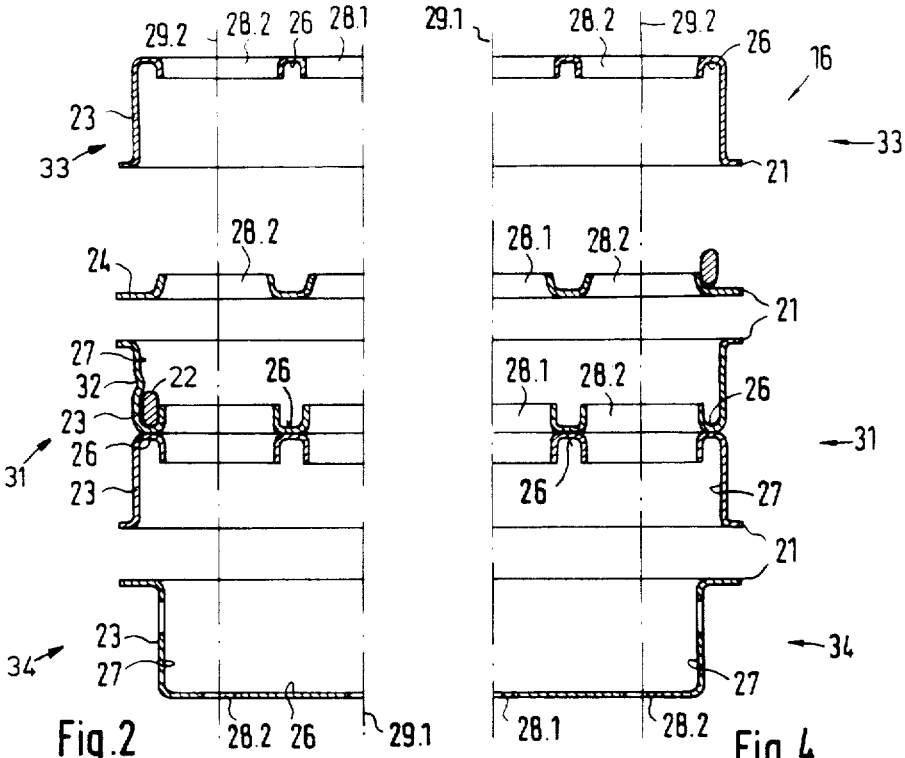
Fig.2
Fig.4
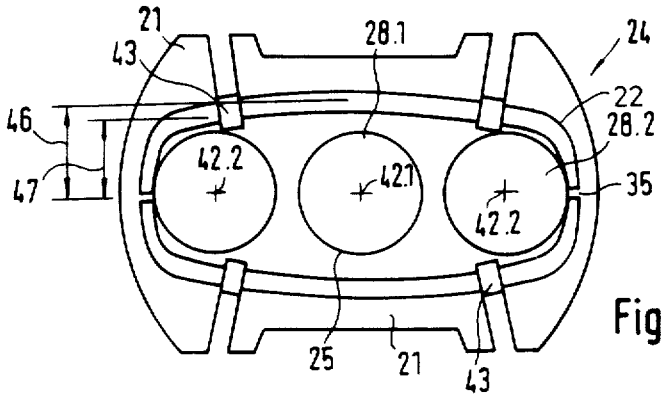
Fig.5
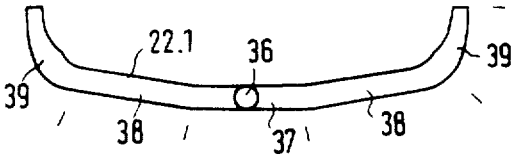
Fig.6
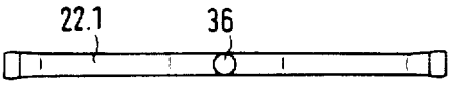
Fig.7

DEVICE FOR ADJUSTING ELECTRON BEAMS IN A CATHODE-RAY TUBE

BACKGROUND OF THE INVENTION

The present invention relates to a device for adjusting electron beams in a cathode-ray tube and particularly the convergence and colour purity of a colour-picture tube comprising an electron gun with electrodes which is housed in the tube neck, which extends in the z-direction. The gain produces at least two electron beams lying in an x-z plane. The adjusting device includes a magnetic ring which is attached to the electron gun and is magnetizable from outside and whose two long sides and two short sides enclose an oblong area which is normal to the electron-beam plane and whose long axis (x-axis) lies in the electron-beam plane, while its short axis (y-axis) is perpendicular thereto.

A colour-picture tube with a device of this kind was shown at the "Electronica 1980" exhibition. The device itself is described in "Funkschau" 26/1980, page 57, in an article on that exhibition. The magnetic ring is made of an iron-cobalt-vanadium alloy and consists of two parts placed end to end leaving air gaps. It is fastened in the focusing electrode of the electron gun right in front. To adjust colour purity and static convergence, it is magnetized from outside, i.e., through the tube neck.

Each part of the magnetic ring has an inwardly directed curvature at the center of its long side. The purpose of such a curvature is described in German patent application No. P 30 03 197. It is to move all three electron beams horizontally, i.e., to the left or right, by equal values during colour-purity adjustment. To achieve this purpose, it was found to be advantageous if the distance between the long sides of the ring decreases from the outer portions toward the center. It may decrease uniformly from the edge toward the center, or an inward curvature toward the central electron beam may be provided.

With a device of the above kind it is possible to adjust electron beams in cathode-ray tubes and particularly in colour-picture tubes to achieve colour purity and static convergence. It is known, however, that magnetic fields not only deflect an electron beam but also influence the shape of the beam, i.e., the distribution of the electrons moving therein. DE-AS No. 11 33 838, for example, proposes to use magnetic bars in an electron-beam tube for beam shaping.

SUMMARY OF THE INVENTION

The object of the invention is to provide a device of the above kind which not only permits satisfactory adjustment of the positions of electron beams in relation to each other but also has a favourable effect on beam focus.

According to the invention, this object is attanined by making the y-distance of a magnetic ring of the above kind from the central axes of the outer electron beams smaller than the y-distance of the ring from the central axis of the central electron beam. It was found that this measure not only increases the focus of the electron beams striking the screen as compared to the focus of the beams in the above-mentioned tubes but also reduces the effects of the so-called halo. The "halo" effect refers to the error which results in a line appearing to have a weak aureole on one or both sides and is mainly apparent at the edges of the screen. It was also observed that in colour-picture tubes where three spots have to be moved on the screen over several millimeters to adjust colour purity, the novel arrangement permits a more uniform adjustment of all three beams than is possible with the arrangement shown at the "Electronica" exhibition.

Advantageous designs of a magnetic ring according to the invention are dependent on the way in which the ring is fixed to the electron gun and on the position of the ring in the electron gun in the z-direction. Magnetic rings can be fixed particularly securely if they are shaped so as to rest against the inside wall of a cup-shaped electrode at only three points. This can be achieved in an especially simple manner by dividing the magnetic ring into two parts which have a radius of curvature greater than that of the wall of the electrode and just touch this wall at three points. Such a partial ring can be secured simply by forming inwardly directed wrinkles in the wall of the electrode directly above the partial ring lying on the bottom of the cup. In electron guns where the central beam is to be influenced by a magnetic field which is more inhomogeneous than that influencing the outer beams, each of the long sides of the magnetic ring advantageously runs parallel to the x-axis except in its central portion, where it is bent away from the x-axis. Conversely, in electron guns where the outer beams are to be subjected to a magnetic field which is more inhomogeneous than that influencing the central beam, it is advantageous to use a magnetic ring which, in about a region of the x-coordinate corresponding in value to the x-coordinate of an outer electron beam, has each of its long sides bent in the y-direction toward the respective outer electron beam, and whose distance from the x-axis on both sides of such a bent region is greater than that in the bent region.

Particularly with regard to the adjustment of colour purity in three-beam picture tubes, it has proved advantageous to choose the ratio of the central portion of each part of the focus-improving magnetic ring to the outer portions so that each portion covers about one third of the overall length of a long side.

BRIEF DESCRIPTION OF THE DRAWINGS

Further advantages, embodiments, and features of the invention will become more apparent from the following description taken in conjunction with the accompanying drawings, in which:

FIG. 2 is an exploded longitudinal section through the left-hand half of the focusing electrode of the electron gun shown in FIG. 1, with the magnetic ring fastened in the central part of the focusing electrode;

FIG. 4 is an exploded longitudinal section through the right-hand half of the focusing electrode of the electron gun shown in FIG. 1 but with a magnetic ring secured to the intermediate plate of the focusing electrode;

FIG. 5 is a top view of the intermediate plate with the magnetic ring of FIG. 4 fastened thereto;

FIG. 6 is a top view of one half of the magnetic ring of FIG. 3;

FIG. 7 is a side view of the half ring shown in FIG. 6;

DETAILED DESCRIPTION

Figure 1:
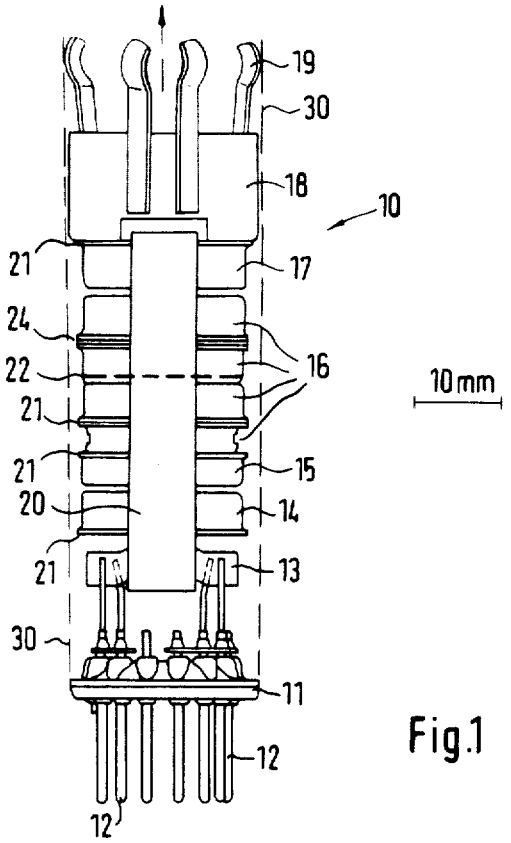
FIG. 1 is a side view of an electron gun in a position in which the electron-beam plane is parallel to the plane of the paper, with a magnetic ring fitted in the focusing electrode.

The electron gun 10 of FIG. 1 has a pressed glass base 11, in which pins 12 are sealed. The pins 12 are conductively connected to contact tags 13. The latter are followed by a modulator electrode 14, a control electrode 15, a focusing electrode 16, an anode 17, and a convergence cup 18 with contact springs 19. At this point is should be noted that in the case of electron guns the end with the pressed glass base is usually referred to as "the lower end", while that with the convergence cup 18 is called "the upper end". In this sense, the terms "upper"/"above" and "lower"/"below" are used in this application too. The individual components of the electron gun 10, i.e., the contact tags 13 and the electrodes 14 to 17, are held by two glass beads 20 which are softened by heat during the manufacturing process and in which the rims 21 of the electrodes are then embedded. In the side view of FIG. 1, only one of two glass beads 20 is visible. The convergence cup 18 is joined to the anode 17 by spot welding. For clarity, neither all connections between the pins 12 and the tags 13 nor the cathodes and heaters are shown.

Fitted in the focusing electrode 16 is a magnetic ring 22, which is indicated in FIG. 1 by broken lines because it is not visible from outside in the side view. FIGS. 2, 3, 6, and 7 show the magnetic ring 22 of FIG. 1 in greater detail. The exploded view of FIG. 2 illustrates the structure of the focusing electrode 16. The latter consists of four electrode parts 23 and an intermediate plate 24. Each electrode part 23, like the modulator electrode 14, the control electrode 15, and the anode 17, is a metal cup with a bottom 26, a wall 27, and a rim 21. It has three circular apertures for the passage of electron beams, as can be seen in the top view of FIG. 3. The central aperture 28.1 is traversed by a central beam 29.1, and each of the two outer apertures 28.2 is traversed by one of two outer beams 29.2. The positions of the three electron beams 29.1 and 29.2 lie in one plane. The apertures 28 in each electrode part 23 are arranged side by side, which leads to an oval shape of the electrode part 23. The plane in which the electron beams 29.1 and 29.2 lie will be referred to as the "x-z plane", the z-direction being the longitudinal direction of the electron gun 10 and the tube neck 30 housing the electron gun 10. The tube neck 30 and the z-direction are indicated in FIG. 1 by broken lines. The y-direction is perpendicular to the x-z plane, which is determined by the three electron beams 29.1 and 29.2. Present-day colour-picture tubes are constructed so that the x-axis is horizontal, while the y-axis is vertical.

To assemble the focusing electrode 16, two electrode parts 23 are set together at their bottoms and joined by spot welding to form a central part 31. The magnetic ring 22 is then put in the upper electrode part 23 of this central part 31 and secured in position by wrinkles 32. The wrinkles 32 are provided in the wall 27 directly above the magnetic ring 22 and point toward the inside of the electrode part 23. Then, the intermediate plate 24 and the rim 21 of an electrode part 23 forming an upper part 33 are placed on the upper rim 21 of the central part 31. In similar fashion, the rim 21 of a fourth electrode part 23, forming a lower part 34, is placed on the lower rim 21 of the central part 31. All parts are then held by the glass beads 20 pressed into the rims 21.

Figure 3:
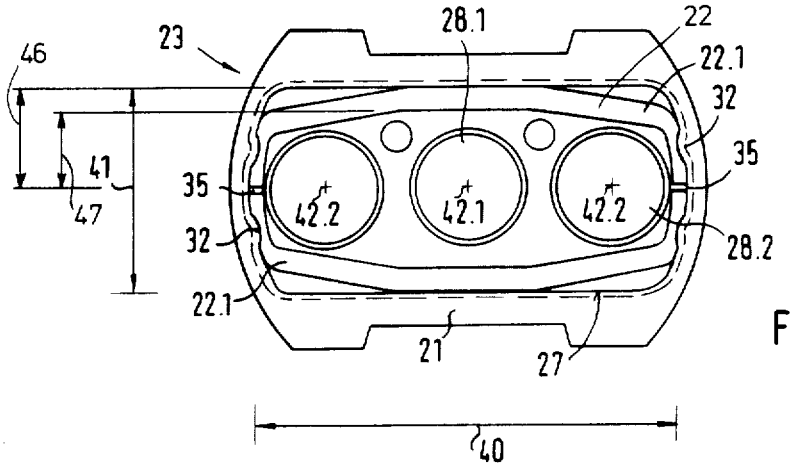
FIG. 3 is a top view of the central part of the focusing electrode of FIG. 2 with the magnetic ring fitted therein.

The shape of the magnetic ring 22 and the way in which it is secured in position by wrinkles 32 are apparent from FIGS. 3, 6, and 7. The magnetic ring 22 consists of two like parts 22.1 which form an oval ring divided along the x-axis. The parts 22.1 are placed end to end leaving air gaps 35. For clarity, the air gaps 35 are shown greatly enlarged, so that it may look in FIGS. 3, 5, 8, and 9 as if the ends of the parts 22.1 do not lie directly next to each other. However, the magnetic ring 22 may also be closed, or its parts may be spaced greater distances apart and form a ring which encloses a closed area.

The parts 22.1 of the magnetic ring are formed from a wire made, for example, of an iron-cobalt-vanadium alloy. The wire is circular, as is shown in the wire cross sections 36 of FIGS. 6 and 7. Its diameter is 1.1 mm, but it may also have a different gauge, e.g., 0.8 mm. Each part 22.1 of the magnetic ring has a central region 37 and two outer regions 38. The central region 37 runs parallel to the x-axis, while the outer portions 38 are inclined to the x-axis at the same angle. The end portions 39 of the parts 22.1 of the magnetic ring are almost perpendicular to the central portion 37. When the magnetic ring 22 has been fitted together, a central portion 37 and the two adjoining outer portions 38 form a long side 40, and two adjacent end portions 39 form a short side 41. A central portion 37 and an outer portion 38 are of the same length. The overall dimensions of the magnetic ring 22 are chosen so that its outer portions 38 and its end portions 39 rest against the inside wall 27 of the cup. The diameters of the magnetic ring 22 in the x-direction and the y-direction are 20.45 mm and 9.4 mm, respectively. FIGS. 2 to 9 are thus shown enlarged, while FIG. 1 is an approximately full-size drawing.

The magnetic ring shown in FIG. 3 is held in place by four wrinkles 32 formed in the wall 27 of the cup above the end portions 39. A further wrinkle 32 may be provided above each central portion 37, but this proved to be not absolutely necessary for securely holding the ring in place.

The magnetic ring 22 serves to influence the positions and/or shapes of the electron beams 29.1 and 29.2. In colour-picture tubes, the primary purpose of the magnetic ring 22 is to influence the positions of the electron beams 29.1 and 29.2 to achieve colour purity and convergence. To accomplish this, it is suitably magnetized from outside through the tube neck 30 by means of a magnetizing apparatus (not shown). It was found, however, that such a magnetization for positioning the beams also influences the focus of the beam. An electron beam 29.1 and 29.2 may either become unsharp as a whole i.e., the spot produced by it on the tube screen may increase in diameter, or result in a halo error, i.e., an aureole around a line. However, the beam shape is influenced by a magnetic field of the magnetic ring 22 only when the magnetic ring 22 is magnetized to influence the positions of the beams 29.1 and 29.2. However, if magnetization is necessary, as is the case in the vast majority of cathode-ray tubes, the shape of the magnetic ring 22 results in the influence of the ring on the beam focus being more favourable than that of the prior art ring. The magnetic ring of FIG. 9 differs from the prior art ring in that the y-distance 46 of the central axis 42.1 of the central electron beam 29.1 from the magnetic ring 22 is greater than the y-distance 47 of the central axis 42.2 of an outer electron beam 29.2 from the magnetic ring 22. This is due to the fact that the outer portions 38 are inclined to the x-axis. The difference between the y-distances 46 and 47 is typically about 0.5 to 1 mm.

The embodiment so far described relates to a magnetic ring 22 as is used to advantage in a thin-neck tube with a high-voltage- focusing electron gun 10 of a given design. The electron gun described comprises several cupshaped electrodes where the magnetic ring can be placed on the bottom 26 and secured in the wall 27 of the cup by wrinkles 32. However, there are also electron guns with plate-shaped electrodes on which the magnetic ring 22 must be mounted in a suitable manner. An embodiment is shown in FIGS. 4 and 5. The attachment and shape of the magnetic ring 22 may also depend on whether the ring is used on an electron gun for a thin-neck tube with a neck diameter of 29 mm, a thick-neck tube with a neck diameter of 35 mm, a tube with a different neck diameter, a Trinitron tube, or a multibeam oscilloscope tube, for example. What is important for the favourable effect on beam focus is that the y-distance of the central electron beam from the magnetic ring 22 should be greater than the y-distance of an outer beam from the ring. Depending on the design of the electron gun, it may be more advantageous to attach the magnetic ring 22 on either the inside or outside of a cup-shaped electrode or further down or up in the electron gun. The magnetic ring 22 may also have only one air gap or consist of a greater number of parts and, consequently, have several air gaps, or it may be a closed ring. The most advantageous position and attachment of the magnetic ring 22 may also depend on the voltages applied to the electrodes. The embodiment shows an electron gun 10 in which a high voltage of about 7 kV is applied to the focusing electrode 16. However, electron guns are in use on a large scale where only about 4.5 kV are applied to the focusing electrode 16. Other electron guns differ from the gun shown here in that instead of electrodes common to all three electron beams 29.1 and 29.2, three guns with individual electrodes for each electron beam 29.1 and 29.2 are present. However, the individual guns all lie in one plane, so that magnetic rings can be used which enclose an oblong area. For all types of electron guns, the magnetic ring 22 may be made from circular wire as described here, from wire of oval section or from flat wire, for example. It should be emphasized once again that the essential prerequisite for the favourable effect of the magnetic ring on the focus of the electron beams 29.1 and 29.2 is that the ring, which encloses an oblong area, should be shaped so as to lie closer to the outer beams 29.2 than to the central beam 29.1 when looking in the y-direction. The most advantageous place and kind of attachment of such a magnetic ring then depends on the specific design of the electron gun and must be determined by experiment.

A selection of solutions besides those described with the aid of FIGS. 1 to 3 and 6 and 7 will now be explained with the aid of FIGS. 4, 5, 8, and 9.

FIGS. 4 and 5 show a modified manner of fixing a magnetic ring 22. The magnetic ring 22 is placed on the intermediate plate 24 and fixed by means of tongues 43 bent up from the rim 21 of the intermediate plate 24. There are four tongues 43 which clamp the ring in pairs at the long sides 40 near the short sides 41. In this embodiment, the long sides 40 of the magnetic ring 22 are curved outwardly. The diameter in the y-direction is such that, when the upper part 33 is placed on the intermediate plate 24, its wall 27 touches the outer rim of the magnetic ring 22 in the y-direction and slightly urges it inwards, whereby the ring is additionally secured in place. The bent shape shown in FIGS. 4 and 5 is also advantageous for a magnetic ring placed in cup-shaped electrode part 23, the more so if the end portion 39, too, are shaped so as to rest against the longitudinal wall of the part 23 at one point only. Thus, each part 22.1 of the magnetic ring rests against the wall 27 of the cup at only three points and can be particularly securely fixed in place by means of wrinkles 32 formed above those points. The parts 22.1 of the magnetic ring shown in FIGS. 4 and 5, like the parts 22.1 of the ring shown in FIGS. 6 and 7, are stamped at their end portions to achieve a reduction of cross-sectional area. This is necessary because in various designs of electron guns the space available between the apertures 28 for the passage of electron beams and the wall 27 of the cup is smaller than the above-mentioned value of 1.1 mm for the wire cross-section 36, namely only 0.6 or 0.8 mm.

Figure 8:
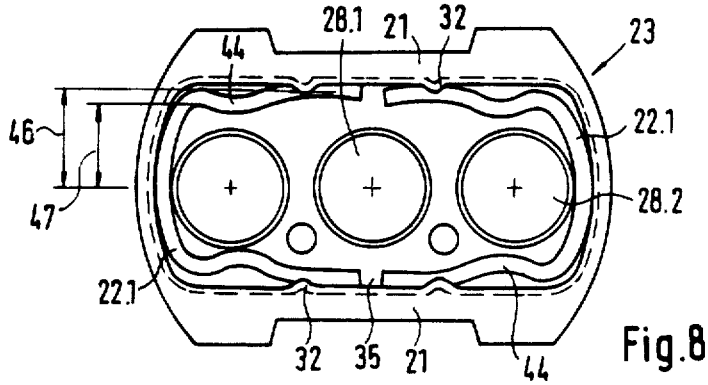
FIG. 8 is a top view of the central part of a focusing electrode containing a magnetic ring having inwardly bent portions in the region of the outer electron beams.

Besides the distance of the magnetic ring 22 from the electron beams 29, the shape of the magnetic ring near the electron beams influences the focus of the beams. It is known that in almost all conventional electron guns the central electron beam 29.1 and the outer electron beams 29.2 have different shapes for design reasons. For instance, the central electron beam may be circular, while the outer beams are oblong in the x- or y-direction, or the reverse may be true, or a combination of such cases may exist. In such cases, a compensating influence can be exerted on the different beam shapes by giving the magnetic ring 22 a suitable shape. If primarily the outer electron beams 29.2 must be influenced in an inhomogeneous manner, it is advantageous to use a magnetic ring 22 shaped as shown in FIG. 8, where approximately in a region of the x-coordinate corresponding in value to the x-coordinate of an outer electron beam 29.2, each of the long sides 40 is bent in the y-direction toward the respective outer electron beam 29.2, and where on both sides of such a bent region 44, each of the long sides is further from the x-axis than in the bent region 44. The magnetic ring 22 of FIG. 8 is divided into two parts 22.1 in the y-axis. The parts 22.1 thus have the shape of a U whose two legs press against the long side of the wall 27 of the cup. Thus, the stress exerted by the parts 22.1 secures them in the electrode part 23. To provide additional security, however, four wrinkles are formed in the long side of the wall 27 of the cup shown in FIG. 8.

Figure 9:
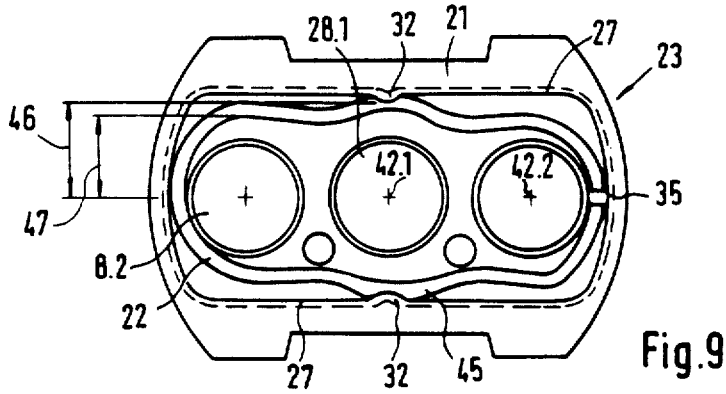
FIG. 9 is top view of the central part of a focusing electrode containing a magnetic ring having outwardly bent portions in the region of the central electron beam.

An embodiment of a magnetic ring 22 with which a stronger inhomogeneous influence can be exerted on the central electron beam 29.1 than on the outer beams 29.2 is illustrated in FIG. 9. This magnetic ring 22 is shaped so that each of the long sides 40 runs parallel to the x-axis except in its central portion 37, where it is bent away from the x-axis. The magnetic ring 22 is divided on the x-axis at only one point and, consequently, has only one air gap 35. It is held in the wall 27 of the cup by two wrinkles 32 formed above the outwardly bent portion 45. It is also possible to use closed magnetic rings, which can be produced, for example, by casting or pressing in a suitable mould or die.

Figure 10:
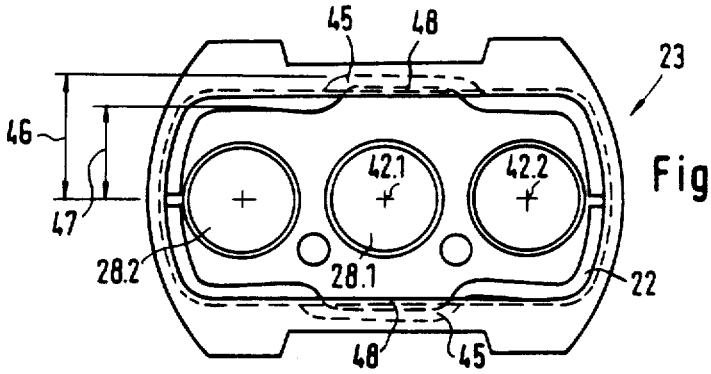
FIG. 10 is a top view similar to that of FIG. 9, but the central part has openings for the outwardly bent central portions of the magnetic ring.

The magnetic ring 22 in the embodiment of FIG. 10 is also bent outwardly in its central portions 37 but to the point that the outwardly bent portions 45 extend through openings 48 provided in the electrode part 23. The magnetic rings 22 can thus have a greater distance from the electron beams than magnetic rings accommodated completely within a cup-shaped electrode part 22 without recesses 48. The locking of the central portions 37 in corresponding openings 48 also ensures that the magnetic ring 22 is securely held in place.

I claim:

1. Apparatus for generating and adjusting electron beams in a cathode-ray tube comprising:

an electron gun for producing a central and two outer electron beams each along a respective central axis extending in a z direction and lying in an x-z plane, said gun having electrodes and adapted to be housed in the neck of said cathode ray tube, said gun extending in a z-direction;

a magnetic ring attached to said gun, said ring being magnetizable from outside said neck, said ring having two long sides and two short sides defining an oblong area, said oblong area being normal to said x-z plane, said oblong area having its longer axis lying in said x-z plane and having its shorter axis perpendicular to said x-z plane, said ring being formed such that the distance in a y direction of said ring from the respective said central axis of each of said two outer electron beams is shorter than the distance in the y direction of said ring from said central axis of said central electron beams.

2. Apparatus in accordance with claim 1, wherein each of said two long sides comprises a central portion parallel to the x axis and outer portions extending toward said x axis.

3. Apparatus in accordance with claim 1, wherein each of said two long sides runs parallel to the x axis except in a central portion, each said central portion being bent away from said x axis.

4. Apparatus in accordance with claims 2 or 3, wherein each of said long sides comprises a cental portion and two out portions, each of said central portions and two outer portions having a length in the x direction equal to approximately one third of the length of each of said long sides in said x direction.

5. Apparatus in accordance with claim 1, wherein each of said two long sides curves away from the x axis.

6. Apparatus in accordance with claim 2, wherein the portions of each of said two long sides adjacent the outer ones of said electron beams is bent in the y direction toward the respective outer one of said electron beams, and each of said two long sides is bent in an outward y direction on both sides of said portions.

7. Apparatus in accordance with claim 1, wherein said magnetic ring is divided into two parts.

8. Apparatus in accordance with claim 2, wherein said magnetic ring is divided into two parts.

9. Apparatus in accordance with claim 3, wherein said magnetic ring is divided into two parts.

10. Apparatus in accordance with claim 4, wherein said magnetic ring is divided into two parts.

11. Apparatus in accordance with claim 5, wherein said magnetic ring is divided into two parts.

12. Apparatus in accordance with claim 6, wherein said magnetic ring is divided into two parts.

13. Apparatus in accordance with claim 1, werein said electron gun comprises a cup shaped electrode, said cup shaped electrode and said magnetic ring each being adapted such that said magnetic ring rests against the wall of said cup shaped electrode at only three predetermined bearing points.

14. Apparatus in accordance with claim 2, wherein said electron gain comprises a cup shaped electrode, said cup shaped electrode and said magnetic ring each being adapted such that said magnetic ring rests against the wall of said cup shaped electrode at only three predetermined bearing points.

15. Apparatus in accordance with claim 3, wherein said electron gun comprises a cup shaped electrode, said cup shaped electrode and said magnetic ring each being adapted such that said magnetic ring rests against the wall of said cup shaped electrode at only three predetermined bearing points.

16. Apparatus in accordance with claim 4, wherein said electron gun comprises a cup shaped electrode, said cup shaped electrode and said magnetic ring each being adapted such that said magnetic ring rests against the wall of said cup shaped electrode at only three predetermined bearing points.

17. Apparatus in accordance with claim 5, wherein said electron gun comprises a cup shaped electrode, said cup shaped electrode and said magnetic ring each being adapted such that said magnetic ring rests against the wall of said cup shaped electrode at only three predetermined bearing points.

18. Apparatus in accordance with claim 6, wherein said electron gun comprises a cup shaped electrode, said cup shaped electrode and said magnetic ring each being adapted such that said magnetic ring rests against the wall of said cup shaped electrode at only three predetermined bearing points.

19. Apparatus in accordance with claim 7, wherein said electron gun comprises a cup shaped electrode, said cup shaped electrode and said magnetic ring each being adapted such that said magnetic ring rests against the wall of said cup shaped electrode at only three predetermined bearing points.

20. Apparatus in accordance with claim 1, wherein said electron gun comprises a cup shaped electrode; and wherein said magnetic ring is fastened at the bottom of said cup shaped electrode.

21. Apparatus in accordance with claim 2, wherein said electron gun comprises a cup shaped electrode; and wherein said magnetic ring is fastened at the bottom of said cup shaped electrode.

22. Apparatus in accordance with claim 3, wherein said electron gun comprises a cup shaped electrode; and wherein said magnetic ring is fastened at the bottom of said cup shaped electrode.

23. Apparatus in accordance with claim 4, wherein said electron gun comprises a cup shaped electrode; and wherein said magnetic ring is fastened at the bottom of said cup shaped electrode.

24. Apparatus in accordance with claim 5, wherein said electron gun comprises a cup shaped electrode; and wherein said magnetic ring is fastened at the bottom of said cup shaped electrode.

25. Apparatus in accordance with claim 6, wherein said electron gun comprises a cup shaped electrode; and wherein said magnetic ring is fastened at the bottom of said cup shaped electrode.

26. Apparatus in accordance with claim 7, wherein said electron gun comprises a cup shaped electrode; and wherein said magnetic ring is fastened at the bottom of said cup shaped electrode.

27. Apparatus in accordance with claim 13, wherein said cup shaped electrode is oval.

28. Apparatus in accordance wtih claim 20, wherein said cup shaped electrode is oval.

29. Apparatus in accordance with claim 13, wherein said electron gun comprises a cup shaped electrode; and wherein said magnetic ring is fastened at the bottom of said cup shaped electrode.

30. Apparatus in accordance with claim 14, wherein said electron gun comprises a cup shaped electrode; and wherein said magnetic ring is fastened at the bottom of said cup shaped electrode.

31. Apparatus in accordance with claim 15, wherein said electron gun comprises a cup shaped electrode; and wherein said magnetic ring is fastened at the bottom of said cup shaped electrode.

32. Apparatus in accordance with claim 16, wherein said electron gun comprises a cup shaped electrode; and wherein said magnetic ring is fastened at the bottom of said cup shaped electrode.

33. Apparatus in accordance with claim 17, wherein said electron gun comprises a cup shaped electode; and wherein said magnetic ring is fastened at the bottom of said cup shaped electrode.

34. Apparatus in accordance with claim 18, wherein said electron gun comprises a cup shaped electrode; and wherein said magnetic ring is fastened at the bottom of said cup shaped electrode.

35. Apparatus in accordance with claim 19, wherein said electron gun comprises a cup shaped electrode; and wherein said magnetic ring is fastened at the bottom of said cup shaped electrode.

36. Apparatus in accordance with claim 27, wherein said magnetic cup shaped electrode comprises at least two wrinkles in said wall located above said bearing points and directed inwardly to retain said magnetic ring.

* * * * *